US007117769B2

(12) United States Patent
Somers

(10) Patent No.: US 7,117,769 B2
(45) Date of Patent: Oct. 10, 2006

(54) SOCKET WRENCH

(76) Inventor: Steve Somers, W. 25 Oakdale La., Mundelein, IL (US) 60035

( * ) Notice: Subject to any disclaimer, the term of this patent is extended or adjusted under 35 U.S.C. 154(b) by 730 days.

(21) Appl. No.: 10/007,189

(22) Filed: Nov. 8, 2001

(65) Prior Publication Data

US 2002/0121164 A1 Sep. 5, 2002

Related U.S. Application Data

(60) Provisional application No. 60/253,533, filed on Nov. 28, 2000.

(51) Int. Cl.
*B25B 23/16* (2006.01)

(52) U.S. Cl. ..... 81/177.75; 81/121.1

(58) Field of Classification Search ..... 81/121.1, 81/124.4, 125.1, 177.75, DIG. 11
See application file for complete search history.

(56) References Cited

U.S. PATENT DOCUMENTS 1,478,736 A * 12/1923 Gadberry ..... 81/124.4
1,584,208 A * 5/1926 Bellows ..... 81/124.4
4,807,499 A * 2/1989 Martinez ..... 81/177.75
4,936,701 A * 6/1990 Allen et al. ..... 81/177.75
5,048,379 A * 9/1991 Gramera et al. ..... 81/121.1
5,186,083 A * 2/1993 Hsiao ..... 81/124.4
5,409,332 A * 4/1995 Chabot et al. ..... 403/114
6,092,441 A * 7/2000 Jarvis ..... 81/177.75
6,109,142 A * 8/2000 Learng ..... 81/DIG. 11
6,269,717 B1 * 8/2001 Bollinger ..... 81/124.4

* cited by examiner

*Primary Examiner*—Lee D. Wilson

(57) ABSTRACT

A socket wrench is provided which performs the functions heretofore carried out by two separate wrenches. To this end, the present invention provides a wrench where each end thereof selectively acts (a) as a receiving end for a nut or other fastener to be rotated by the wrench and of a different size than that to be received by the other end of the wrench and, (b) as the receiving end of a driver member which is to rotate the wrench to turn the nut or other fastener surrounded by the other end of the wrench. Preferably, the same driver member is insertable into either end of the wrench.

8 Claims, 2 Drawing Sheets

20B
36
40
38
39
36a
20C
25a
28b
29
23
20B
4
38
39
42
36a
36
20C
34
21
20
34
32
20a
20a-1
20"
40a"
20'
20
40a
40a'
40

SOCKET WRENCH

I. RELATED APPLICATION

This application is based on U.S. Provisional Application Ser. No. 60/253,533, filed Nov. 28, 2000.

II. BACKGROUND AND SUMMARY OF INVENTION

The present invention in its broadest form improves upon the prior art by designing the socket wrenches involved so that instead of a wrench with one socket-forming end and one driver-receiving end as in the prior art, each end of the wrench can perform a double function of selectively acting as a fastener-receiving end for a fastener of a different size or as an end to receive preferably the driving end of the same driver or less desirably for a different sized driver. This feature is used both for wrenches in which the opposite ends are fixed ends or ends which can be pivoted with respect to each other, although the pivoted form shown in the drawings is the preferred form.

III. DESCRIPTION OF DRAWINGS

Figures 1, 1A, 1B, 2, 2A, 2B, 3, 3A, 3B:
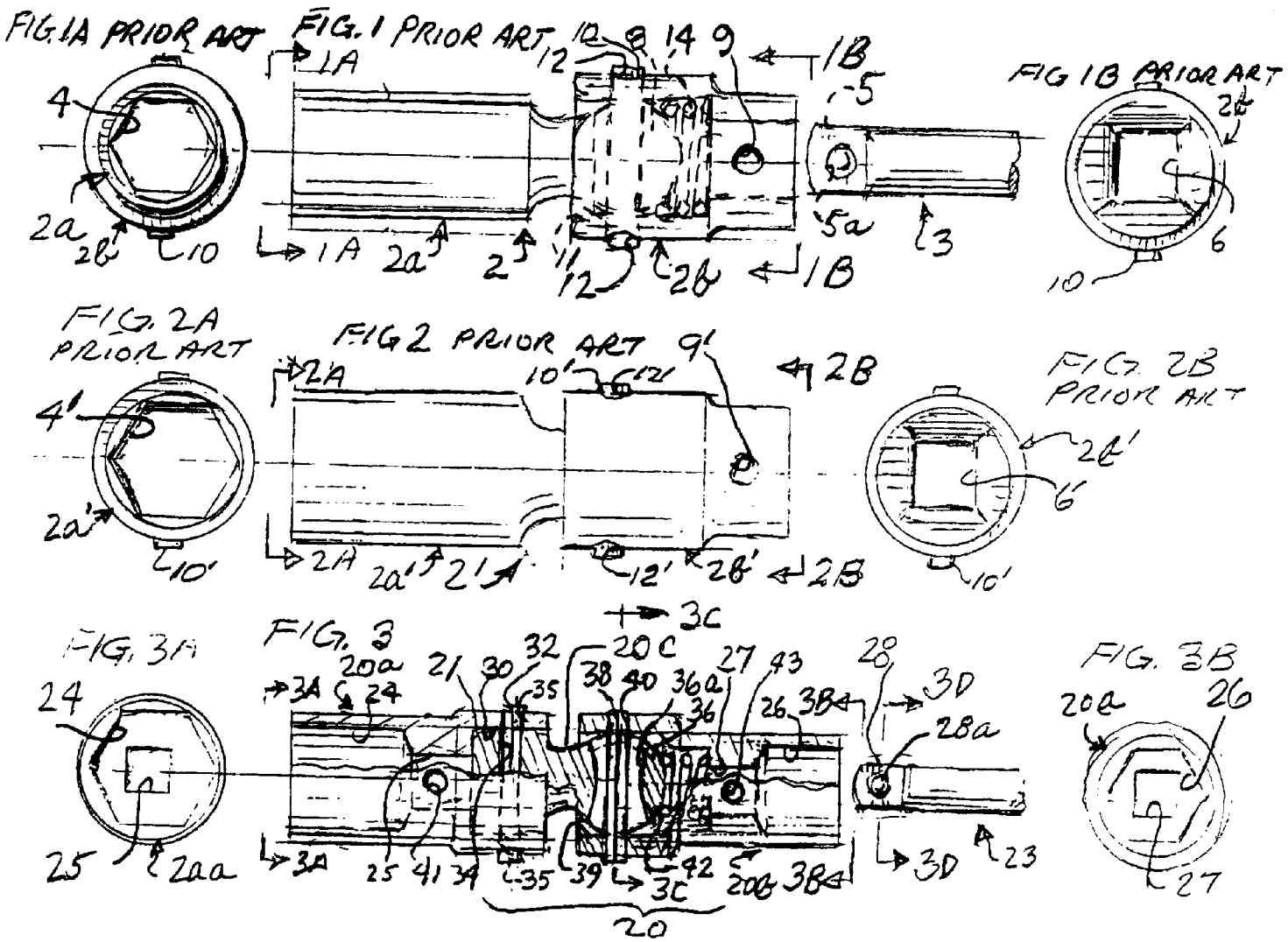
FIG. 1A PRIOR ART
FIG. 1 PRIOR ART
FIG. 1B PRIOR ART
FIG. 2A PRIOR ART
FIG. 2 PRIOR ART
FIG. 2B PRIOR ART
FIG. 1 is a side elevational view of a prior art socket wrench and a driver therefor in position to be inserted into the driver-receiving end of the wrench.
FIG. 1A is an end view of the left end of the prior art wrench shown in FIG. 1, as seen in viewing plane 1A—1A thereof, and showing the outer hexagonal bore thereof for receiving the same sized and shaped nut or other fastener to be rotated thereby.
FIG. 1B is an end view of the right end of the prior art wrench shown in FIG. 1, as seen in viewing plane 1B—1B thereof, and showing the outer rectangular bore thereof for receiving the same sized and shaped rectangular end of the driver shown in FIG. 1.
FIG. 2 is a side elevational view of a prior art socket wrench for receiving the driver shown in FIG. 1, but of a size to receive a nut or other fastener of a larger size than the wrench of FIG. 1 can accommodate.
FIG. 2A is an end view of the left end of the prior art wrench shown in FIG. 2, as seen in viewing plane 2A—2A thereof, and showing the outer hexagonal bore for receiving the same sized and shaped nut or other fastener to be rotated thereby.
FIG. 2B is an end view of the right end of the prior art wrench shown in FIG. 2, as seen in viewing plane 2B—2B thereof,and showing the outer rectangular bore thereof for receiving the rectangular end of the driver shown in FIG. 2.
Figures 3C, 3D, 4, 5:
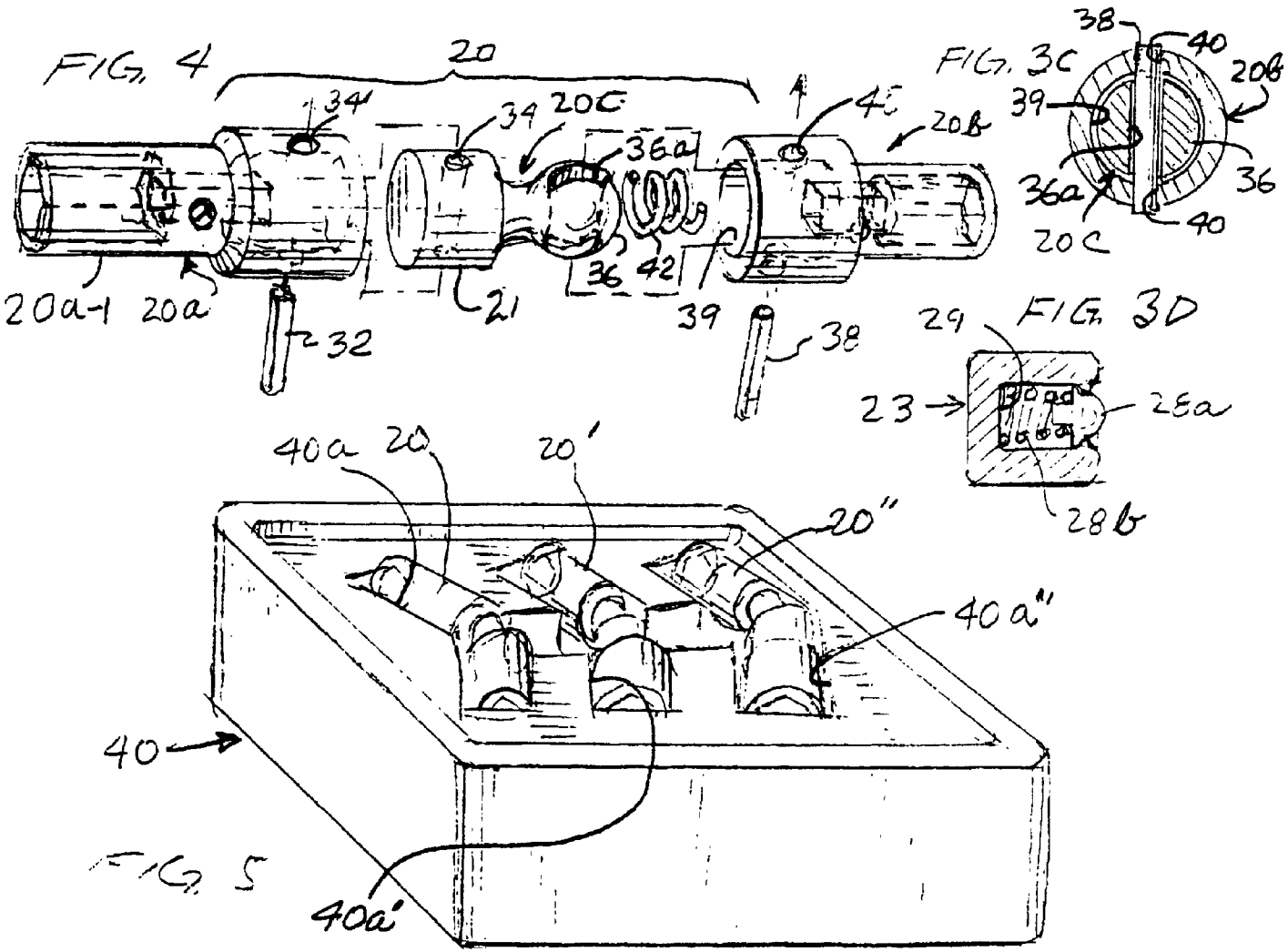

FIG. 3 is a side elevational view of a wrench of the present invention and a driver in position to be inserted into one end of the wrench, where the wrench is uniquely designed to receive at either end thereof the driver there shown, and wherein the opposite ends of the wrench are also respectively designed to receive the nuts or other fasteners of the two sizes which the two prior art wrenches of FIGS. 1 and 2 are needed to rotate the differently sized fasteners involved;

FIG. 3A is an end view of the left end of the wrench of FIG. 3, as seen in viewing plane 3A—3A thereof, and showing an outer hexagonal fastener-receiving bore thereof which is the same size as the hexagonal bore of the prior art wrench of FIG. 2 and a smaller inner rectangular bore thereof for receiving the rectangular end of the driver shown in FIG. 3;

FIG. 3B is an end view of the right end of the wrench of FIG. 3, as seen in viewing plane 3B—3B thereof, and showing the outer hexagonal fastener-receiving bore thereof which is the same size as the smaller hexagonal bore of the prior art wrench of FIG. 1 and a smaller inner rectangular bore thereof for receiving the rectangular end of the driver shown in FIG. 3;

FIG. 3C is a transverse section through the ball-forming portion of the socket wrench shown in FIG. 3, as seen in viewing plane 3C—3C thereof;

FIG. 3D is a sectional view through the end of the driver shown in FIG. 3 taken along section plane 3D—3D and showing the spring urged ball which interlocks with the walls of a hole in the end of the wrench selected to be the driving end thereof;

FIG. 4 is an exploded view of the wrench of the present invention shown in FIG. 3 and showing (a) the left and right socket-forming and driver-receiving parts of the wrench assembly of the invention shown in FIG. 3, and (b) the ball-forming, spring and friction pin parts which interconnect the left and right socket-forming and driver-receiving parts of the wrench assembly, so as to permit the same to be pivoted with respect to each other in the preferred form of the invention; and FIG. 5 is a perspective view of a tray containing in three storage pockets thereof three socket wrenches of the invention, giving the user a selection of 6 socket sizes the prior art required 6 separate wrenches to accommodate.

IV. DETAILED DESCRIPTION OF DRAWINGS

FIGS. 1 and 2 show two prior art socket wrenches 2 and 2' for only receiving at their left ends as illustrated a nut or other fastener having a hexagonal shape of a different size and for receiving at their right ends a driver member 3. Each socket wrench as illustrated is an assembly comprising (a) a left socket-forming part 2*a* or 2*a'* having a different sized outer hexagonal bore 4 or 4' opening onto the outer left end thereof for fitting over a nut or other fastener to be rotated thereby and (b) a right driver-receiving part 2*b* or 2*b'* with an identical square bore 6 or 6' at the right or outer end thereof for receiving the square end of the driver member 3.

The driving end 5 of the driver member 3 has a spring urged ball 5*a* projecting from the side thereof which when the driving end is fully inserted into the bore 6 or 6' snaps into an opening 9 or 9' on the right end of the driver-receiving part 2*b* or 2*b'*. The driver-receiving part 2*b* or 2*b'* has at the inner or left end thereof a ball-receiving bore like 11 shown only on part 2*b* which opens onto the left end thereof to receive a ball-shaped projection 8 shown only on the part 2*a* extending from the socket-forming part 2*a* or 2*a'*. A pin 10 or 10' extending through aligned openings 12—12 or 12'—12' in the driver-receiving part 2*b* or 2*b'* and a suitably shaped slot (not shown) in the ball-shaped projection 8 both anchors the assembly parts 2*a*–2*b* or 2*a'*–2*b'* together and permits these parts to be pivoted with respect to each other in a manner similar to that used in the invention to be described in detail below. This allows the left socket-receiving parts 2*a* or 2*a'* to be applied over a nut or other fastener where there is insufficient clearance space to receive the driver-receiving part 2*b* or 2*b'* when in perfect axial alignment therewith. A coil spring 14 is interposed between the end of ball S and an inner wall of the part 2*b* or 2*b'*.

FIGS. 3 and 4 show the preferred, but not the only, form of the invention. As thee shown, a socket wrench assembly 20 includes left and right main socket-forming and driver-receiving parts 20*a*–20*b* interconnected by a preferably separate ball-forming part 20*c* which permits the socket-forming and driver-receiving parts 20*a* and 20*b* to be pivoted with respect to each other. The ball-forming part 20*c* has a cylindrical end 21 which fits within a similarly sized cylindrical bore 30 at the inner end of the left main assembly part 20*a*. An anchoring pin 32 is shown passing through aligned lateral openings 35—35 at the inner end of the left main assembly part and a lateral opening 34 in the cylindrical end of the ball-forming part 20*c* to secure these parts together.

The right hand end of the ball-forming part 20*c* has a spherical shape to form a ball 36 fitting into a cylindrical bore 39 at the inner end of the right main assembly part 20*b*. The ball 36 has a slot 36*a* which in the longitudinal vertical plane shown in FIG. 3 has an hour glass-shape wider at its top and bottom ends, to permit the ball-forming part 20*c* to be pivoted in this plane relative to the right main assembly part 20*b*. This slot has a width in the transverse plane shown in FIG. 3C which is about the size of an anchoring pin 38 which passes through aligned top and bottom openings 40—40 in the inner end of the right assembly part 20*b* and through the hour glass-shaped slot 36*a*. A coil spring 42 is compressed between the innermost end of the cylindrical bore 39 of the right assembly part 20*b* and the end of the ball 36 to hold the ball-forming part 20*c* and the right assembly part 20*b* in a normal fixed aligned position which can be shifted by pivoting the main assembly parts in the vertical plane referred to. To simplify and minimize the cost of manufacturing the right and left main assembly parts, the cylindrical bores 30 and 39 at the inner ends of the main assembly parts 20*a* and 20*b* are identical and the anchoring pin-receiving holes 35—35 and 40—40 are identical in shape and position so that the ball-forming part 20*c* can be either mounted on the inner end of part 20*a* or 20*b* and fit into the inner end of the other part as described.

What makes the present invention novel is that (a) each of the main assembly parts 20*a* and 20*b* are formed with differently sized outer non-circular (hexagonal in the example shown) socket-forming bores 24 and 26 (see FIGS. 3A and 3B) to receive correspondingly shaped and sized nuts or other fastening means to be rotated by the wrench assembly 20 and (b) smaller preferably but not necessarily identical non-circular (square in the embodiment shown) driver-receiving bores 25 and 27 located between the outer and inner bores 24–30 and 26–39 to receive the rectangular end 28 of the driver member 23 shown in FIG. 3. The driver member can thus be inserted into whatever end of the wrench assembly 20 desired to receive the driver member 23, the other end then forming the desired sized fastener-receiving socket. The right and left assembly parts 20*a* and 20*b* have similarly placed holes 41 and 43 communicating with the driver-receiving bores 25 and 27. As shown in FIGS. 3 and 3D, the square shaped end 28 of the driver member 23 has a detent 28*a* mounted in a recess 29 therein and urged outwardly by a spring 28*b* so that full insertion of the driving end of the driver member 23 into the outer fastener-receiving end of the left or right part 20*a* or 20*b* will cause the detent 28*a* to snap into the hole 41 or 43 to interlock the driver 23 with the wrench assembly 20 of the invention.

FIG. 5 shows a tray 40 with three pockets 40*a*, 40*b*' and 40*a*" one holding the wrench assembly 20 just described and the other holding similar wrench assemblies but with difference socket sizes, so that only three such assemblies are needed for 6 different fastener sizes. In contrast, as above indicated, the prior art required six different wrench assemblies for this purpose.

The form of the invention just described is the preferred, most advantageous form of the invention constituting one aspect of the invention which is the subject of some of the claims to follow, other less preferred forms of the invention form broader aspect thereof as exemplified by the more broadly worded claims to follow.

I claim:

1. Socket wrench-making parts adapted to form a wrench with opposite outer ends with which can be applied over and rotate non-circular elements of at least two sizes, said parts including:

a left and a right external driver member means-receiving part each having a first outer end to be located at a different opposite longitudinal outer end of the wrench when the parts are assembled and an opposite second inner end, said left and right parts respectively having walls defining differently-sized, non-circular sockets in the first outer ends thereof to be located at the opposite longitudinal ends of the assembled parts and applied over differently sized elements to be rotated by the wrench, said sockets each having an end opening thereat onto the exterior of the part involved so that the socket can be applied over and its defining walls interlock with a selected element of corresponding size to be rotated by said wrench and an opposite end opening onto a first smaller driver member-receiving bore in turn opening upon a second ball member-forming part-receiving bore, said first smaller driver member-receiving bore having bore-defining walls adapted to interlock with an external driver member means sized to be inserted into the open end of the associated larger outer socket and then moved inwardly into the associated driver member-receiving bore where it interlocks with said left or right part involved so that rotation of the driver member will rotate the wrench and turn said element enveloped by said socket at the other end of the assembled wrench;

a ball member-forming part adapted to be secured to and between the said second inner ends of said left and right external driver member means-receiving parts, the second inner ends of the left and right parts respectively having walls defining a pair of ball member-receiving surfaces, at least one of which forms a ball-receiving bore; said ball member-forming part having a ball-forming end adapted to adjustably fit in said ball-receiving bore of one of said left and right parts and a second end adapted to be fixedly mounted against the ball member-receiving surfaces of the other of said left and right parts; and pivot-forming first and second means permitting the pivoting of said ball-forming end of said ball member-forming part in the ball-receiving bore involved at least in a plane which includes a longitudinal axis extending between said outer ends of the wrench.

2. The socket wrench-making parts of claim 1 wherein said pivot-forming first means is a pin extendable transversely through a slot in said, ball-forming member, and said pivot-forming second means is said slot having an hour glass-shaped viewed in a longitudinal plane and a constant narrow shape of about the size of said pin viewed in a plane transverse to said axis, to permit rotation of one of said parts relative to the other of same in at least a longitudinal plane in the assembled wrench.

3. The socket wrench-making parts of claim 2 where there is also provided a spring mountable in said ball-receiving bore between the ball-forming end of said ball-forming member and an interior wall of the drive member-receiving part involved to exert a resilient axial force on said ball-forming member permitting the other driver-member means-receiving part to be pivoted in said longitudinal plane.

4. The socket wrench-making parts of claim 1 wherein said ball member-forming part-receiving surfaces of both of said driver member-receiving parts are both bores in said parts and the opposite ends of said ball-forming member are of substantially the same size and construction so that either end of said ball-forming member can be inserted into said bores of either one of said left and right driver member means-receiving parts.

5. The socket wrench-making parts of claim 1 wherein said driver member means-receiving surfaces of said driver member-receiving parts both form bores therein of identical size and shape so that said driver member means can be inserted into either one of driver member-receiving bores, whereby only one driver member is needed to rotate the wrench for the two different sizes of elements to be driven by the wrench.

6. The socket wrench-making parts of claim 1 combined with said driver member means selectively insertable through a selected one of said sockets of said left or right driver member-receiving part into said driver member-receiving bore thereof where the driver means interlocks with the walls thereof to impart rotation to the assembled wrench.

7. A socket wrench which can be applied over and rotate non-circular elements of at least two sizes, said wrench having a longitudinal axis whose opposite longitudinal ends are adapted to fit over differently-sized non-circular elements, said wrench comprising:

left and a right external driver member means-receiving parts at the opposite longitudinal ends of said wrench, said parts having outer ends respectively located at the opposite longitudinal ends of the wrench and respectively having thereat walls defining differently-sized, non-circular sockets, said sockets each having a first longitudinal end opening thereat onto the exterior of the part involved so that the socket can be applied over and its defining walls interlock with a selected element of corresponding size to be rotated by said wrench and a second longitudinal end opening onto a smaller driver member means-receiving bore having bore-defining walls adapted to interlock with an external driver member means sized to be inserted into the open outer end of the associated larger outer socket and then moved longitudinally inwardly into the associated driver member means-receiving bore where it interlocks with the part involved, so that rotation of the driver member will rotate the wrench and turn the element enveloped by said socket at the other end of the assembled wrench;

a ball member-forming part having opposite longitudinal ends secured to and between the second inner ends of said left and right driver member means-receiving parts, the second inner ends of the left and right driver member means-receiving parts having walls defining ball member-receiving bores receiving the opposite longitudinal ends of said ball member-forming part, one of said longitudinal ends of said ball member-forming part fitting within and interlocking with the ball member-receiving bore of one of said left and right driver member means-receiving parts so that rotation of said one part will impart similar rotation to said ball member-forming part, and the other longitudinal end of said ball member-forming part is a ball-forming end which fits into the ball member-receiving bore of the other of said left and right parts; and a pin extending transversely through a slot in said ball-forming member, said slot having an hour-glass shape viewed in a longitudinal plane and a constant narrow shape of about the size of said pin viewed in a plane transverse to said axis, to permit rotation of one of said parts relative to the other of same in at least the longitudinal plane in the wrench.

8. In combination, a socket wrench which can be applied over and rotate non-circular elements of at least two sizes and driver member means to rotate said wrench, said wrench having a longitudinal axis whose opposite longitudinal ends are adapted to fit over differently-sized non-circular elements, said wrench comprising:

left and a right driver member means-receiving parts at the opposite longitudinal ends of said wrench, said driver member means-receiving parts having outer ends respectively located at the opposite longitudinal ends of the wrench and respectively having thereat walls defining differently-sized, non-circular sockets, said sockets each having a first longitudinal end opening thereat onto the exterior of the part involved so that the socket can be applied over and its defining walls interlock with a selected element of corresponding size to be rotated by said wrench and an opposite second longitudinal end of each socket opening onto a smaller driver member means-receiving bore having bore-defining walls adapted to interlock with said driver member means, said driver member means being sized to be inserted into the open outer end of the associated larger outer socket of a selected one of said left and right driver member means-receiving parts and then moved longitudinally inwardly into the associated driver member-receiving bore where it interlocks with the part involved, so that rotation of the driver member means will rotate the wrench and turn said element enveloped by said socket at the other end of the assembled wrench;

a ball member-forming part having opposite longitudinal ends secured to and between said left and right driver member means-receiving parts, the inner ends of the left and right driver member means-receiving parts having walls respectively defining a pair of ball member-receiving surfaces for receiving the opposite longitudinal ends of said ball member-forming part, one of said surfaces forming a ball-receiving bore for receiving a ball at one longitudinal end of said ball member-forming part, and the other surface being a surface for receiving the opposite longitudinal end of said ball member-forming part, one of said longitudinal ends of said ball member-forming part interlocking with the defining walls of said other ball member-receiving surface in one of said left and right socket-forming and driver-receiving parts so that rotation of said one part will impart similar rotation to said ball member-forming part, and the other longitudinal end of said ball member-forming part is a ball-forming end which fits into said ball-receiving bore of the other of said left and right parts; and a pin extending transversely through a slot in said ball-forming member, said slot having an hour-glass shape viewed in a longitudinal plane and a constant narrow shape of about the size of said pin viewed in a plane transverse to said axis, to permit rotation of one of said parts relative to the other of same in at least a longitudinal plane in the wrench.

* * * * *